US005290661A

United States Patent [19]

Idota et al.

[11] Patent Number: 5,290,661

[45] Date of Patent: Mar. 1, 1994

[54] METHOD FOR FORMING IMAGES BY SILVER SALT DIFFUSION TRANSFER

[75] Inventors: Yoshio Idota; Makoto Ishihara; Morio Yagihara, all of Kanagawa, Japan

[73] Assignee: Fuji Photo Film Co., Ltd., Kanagawa, Japan

[21] Appl. No.: 921,134

[22] Filed: Jul. 29, 1992

[30] Foreign Application Priority Data

Jul. 31, 1991 [JP] Japan ..... 3-213015

[51] Int. Cl.[5] ..... G03C 5/54

[52] U.S. Cl. ..... 430/248; 430/230; 430/233; 430/244; 430/249; 430/250; 430/607

[58] Field of Search ..... 430/230, 233, 248, 244, 430/249, 250, 251, 607

[56] References Cited

U.S. PATENT DOCUMENTS

| | | | |
|---|---|---|---|
| 3,287,125 | 11/1966 | Green et al. | 430/250 |
| 3,293,034 | 12/1966 | Green et al. | 430/250 |
| 3,396,022 | 8/1968 | Dersch et al. | 430/607 |
| 4,912,015 | 3/1990 | Idota | 430/248 |
| 5,030,545 | 7/1991 | Tanabe | 430/230 |
| 5,073,473 | 12/1991 | Koya et al. | 430/249 |

FOREIGN PATENT DOCUMENTS 2461514 7/1975 Fed. Rep. of Germany .

*Primary Examiner*—Richard L. Schilling
*Attorney, Agent, or Firm*—Sughrue, Mion, Zinn, Macpeak & Seas

[57] ABSTRACT

A method for sorting images by silver salt diffusion transfer comprising imagewise exposing a light-sensitive element comprising a light-sensitive silver halide emulsion layer, developing the light-sensitive element in the presence of a silver halide solvent using an alkaline processing composition to turn at least a part of unexposed silver halide of the light-sensitive silver halide emulsion layer into a transfer silver halide complex salt, and transferring at least a part of the silver halide complex salt to an image receiving layer comprising a silver precipitating agent to form images on the image receiving layer, wherein at least one compound represented by formula (I) is added to at least one of the light-sensitive element, an image receiving element comprising the image receiving layer, and the processing composition in an amount of at least $1\times10^{-6}$ and less than $1\times10^{-2}$ mol based on one mol of silver applied per unit area ($m^2$):

(I)

wherein Q represents an atomic group for forming a quinone ring; R represents a monovalent group which may be substituted or unsubstituted; and n is an integer of 0 to 4, whereby the maximum density can be increased for a short time.

17 Claims, No Drawings

METHOD FOR FORMING IMAGES BY SILVER SALT DIFFUSION TRANSFER

FIELD OF THE INVENTION

The present invention relates to a method for forming images by silver salt diffusion transfer and a film unit used therein.

BACKGROUND OF THE INVENTION

Silver salt diffusion transfer processes are well known in the art. For example, silver salt diffusion transfer processes are described in A. Rott and E. Weyde, *Photographic Silver Halide Diffusion Processes,* Focal Press, London (1972); J. Stutge, V. Walworth and A. Shepp, *Imaging Processes and Materials: Neblette's Eighth Edition,* Vol. 8, Chapter 6, Instant Photography and Related Reprographic Processes, Van Nostrand Reinhold (1989); and G. Haist, *Modern Photographic Processing,* Vol. 2, Chapter 8, Diffusion Transfer, John Wiley and Sons.

Many kinds of photographic materials can be prepared by the diffusion transfer processes. Namely, it is known that a light-sensitive element in which a silver halide emulsion is applied to a support and an image receiving element in which an image receiving layer containing silver precipitation nuclei is applied to another support are superimposed on each other, and an alkaline processing composition such as a high viscosity or low viscosity alkaline processing composition containing a developing agent and a silver halide solvent, i.e., a processing element, is developed between the two elements described above, whereby a transfer image can be obtained. In practicing the present invention, this photographic material described above is advantageously used.

Another photographic material is known in which a light-sensitive layer and an image receiving layer are applied to the same support, one over the other, and a positive image can be observed through a negative image, utilizing the high covering power of the positive image, as described in U.S. Pat. No. 2,861,885. Further, a photographic material is known in which materials similar to those described above are used where the light-sensitive layer is washed out after diffusion transfer processing to obtain a positive image alone.

Furthermore, another photographic material is known in which a light-sensitive layer of a silver halide, a layer containing a light reflection material such as titanium white, and an image receiving layer containing silver precipitation nuclei are applied to a support, one over the other in this order, and processed, whereby a positive image can be obtained. Moreover, a photographic material is also known in which a light-sensitive element and an image receiving element are integrally laminated on a support, and subjected to diffusion transfer processing, whereby it can be used without separation of the light-sensitive element and the image receiving element. These photographic materials are described in detail in the literature described above.

It is widely desired to reduce the time for formation of images utilizing the silver salt diffusion transfer processes. One method for reducing the time for formation of images encompasses increasing the amount of a developing agent. According to this method, however, metallic luster is developed on the images, the images become reddish in color tone, and the images deteriorate with respect to storage quality, in particular fading quality.

Another method encompasses increasing the amount of silver halide dissolving agent. This method is however undesirable because metallic luster is developed on the images and the images become bluish.

In addition, another method encompasses increasing the amount of silver applied. However, this method has the disadvantages of lowered sensitivity and difficulty in terminating the reaction at the late stage of transfer.

A further method encompasses reducing the thickness of a spacer of an image receiving sheet for determining the developing thickness of processing element to shorten the diffusion transfer distance. According to this method, however, the images are deteriorated in density unevenness, and manufacturing and processing suitability is also lost.

Thus, in the various methods seeking to reduce the time for forming images, many disadvantages result.

SUMMARY OF THE INVENTION

Accordingly, one objective is to provide a method to reduce the time for forming images while preventing the disadvantages described above. This objective and others are obtained by a method for forming images by silver salt diffusion transfer comprising imagewise exposing a light-sensitive element comprising a light-sensitive silver halide emulsion layer, developing the light-sensitive element in the presence of a silver halide solvent using an alkaline processing composition to turn at least a part of unexposed silver halide of the light-sensitive silver halide emulsion layer into a transfer silver halide complex salt, and transferring at least a part of the silver halide complex salt to an image receiving layer comprising a silver precipitating agent to form images on the image receiving layer, wherein at least one compound represented by formula (I) is added to at least one of the light-sensitive element, an image receiving element comprising the image receiving layer, and the processing composition in an amount of at least $1\times10^{-6}$ and less than $1\times10^{-2}$ mol based on one mol of silver applied per unit area ($m^2$):

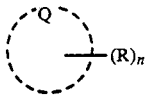

(I)

wherein Q represents an atomic group for forming a quinone ring; R represents a monovalent group which may be substituted or unsubstituted; and n is an integer of 0 to 4.

DETAILED DESCRIPTION OF THE INVENTION

In the method for forming images by silver salt diffusion transfer, the unexposed silver halide retained without turned into the transfer silver halide complex salt is turned into a fog, and the silver halide complex salt retained without transferred is also turned into a fog.

It is preferred that at least one R represents an alkyl group of 1 to 7 carbon atoms which may be substituted, an alkoxy group of 1 to 7 carbon atoms which may be substituted, an aryl group of 6 to 10 carbon atoms which may be substituted, a carboxyl group, a sulfo group, a halogen group or an amino group. The substituent group is preferably selected from a hydroxyl group, a carboxyl group, a sulfo group, a halogen group and an amino group. In particular, a benzoquinone compound is preferred in which R is an alkyl or alkoxy group of 1 to 6 carbon atoms and n is an integer of 2 to 4.

Although the amount of the compound represented by formula (I) to be added varies depending on the structure of the compound, it is at least $1\times10^{-6}$ and less than $1\times10^{-2}$ mol based on one mol of silver applied per unit area ($m^2$), preferably $2\times10^{-6}$ to $5\times10^{-3}$ mol, and more preferably $3\times10^{-6}$ to $2\times10^{-3}$ mol.

The compounds of formula (I) are preferably added to a light-sensitive element, an image receiving element and/or a processing composition. The addition to the processing composition is preferred among others. When the compound of formula (I) is added to the processing composition, the amount of the compound added is at least $1\times10^{-6}$ and less than $1\times10^{-2}$ mol based on one mol of silver applied per unit area ($m^2$) of the light-sensitive element on which the processing composition is developed. When the compound is added to the image receiving element, the amount of the compound added is at least $1\times10^{-6}$ and less than $1\times10^{-2}$ mol based on one mol of silver applied per unit area ($m^2$) of the light-sensitive element on which the image receiving element is superimposed.

The compound of formula (I) of the present invention generally acts as an oxidizing agent. It has not therefore been expected to use a compound of formula (I) in combination with a developing agent. However, when intensive studies for reducing the image forming time were conducted, the compound of formula (I) of the present invention was incidentally tested. As a result, it was surprisingly discovered that it was difficult for metallic luster to develop on images, the drop in sensitivity was reduced and high maximum density could be obtained for a short period of time while maintaining low minimum density, in spite of the addition of a very small amount of a compound of formula (I).

Preferred examples of the compounds used in the present invention include but are not limited to the following compounds:

I-1

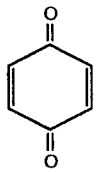

I-2

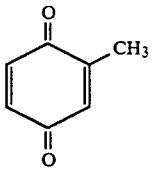

I-3

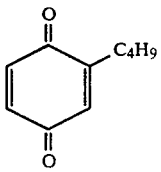

-continued

I-4

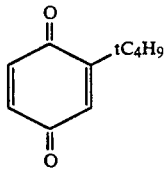

I-5

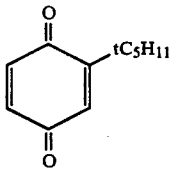

I-6

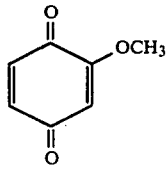

I-7

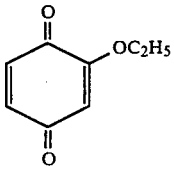

I-8

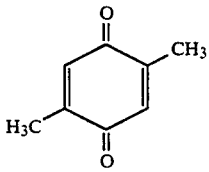

I-9

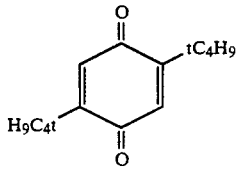

I-10

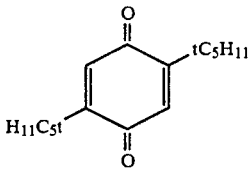

I-11

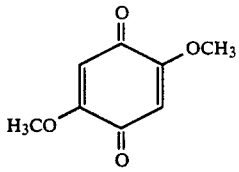

I-12

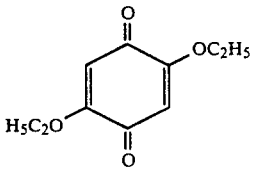

-continued
I-13
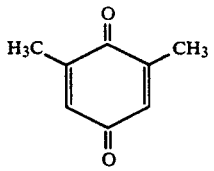
I-14
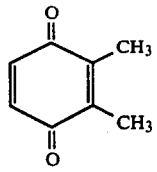
I-15
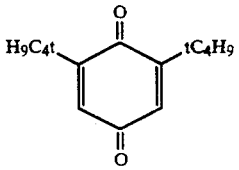
I-16
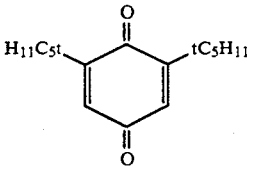
I-17
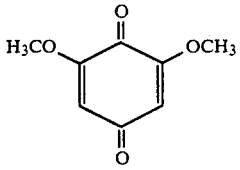
I-18
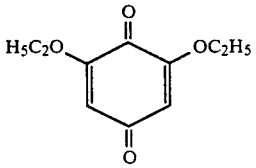
I-19
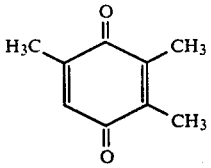
I-20
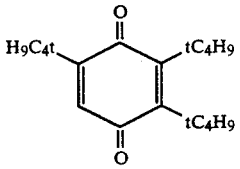
I-21
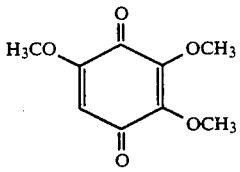
-continued
I-22
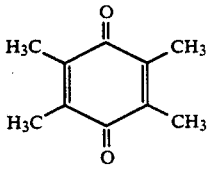
I-23
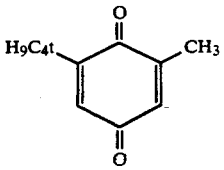
I-24
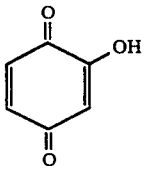
I-25
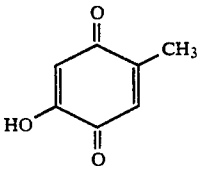
I-26
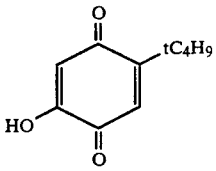
I-27
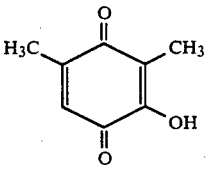
I-28
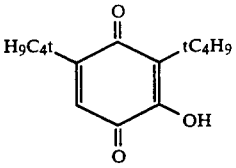
I-29
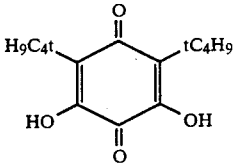
I-30
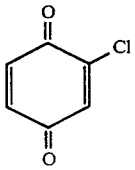

-continued
I-31
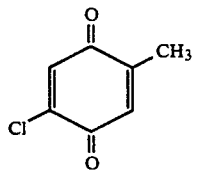
I-32
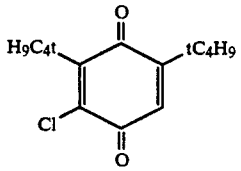
I-33
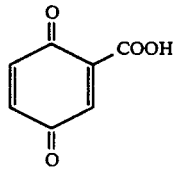
I-34
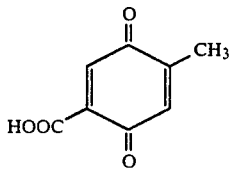
I-35
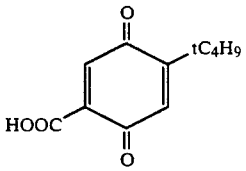
I-36
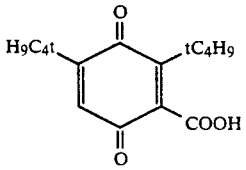
I-37
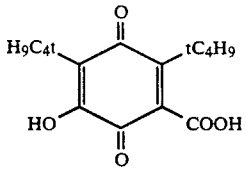
I-38
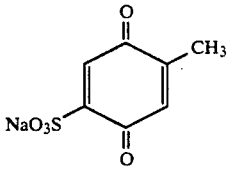
I-39
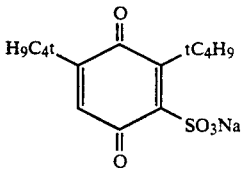
-continued
I-40
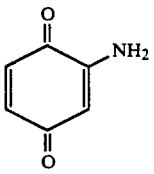
I-41
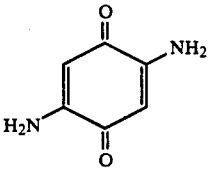
I-42
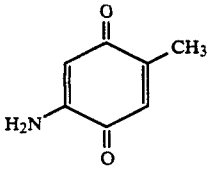
I-43
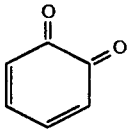
I-44
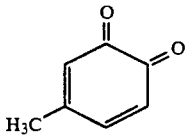
I-45
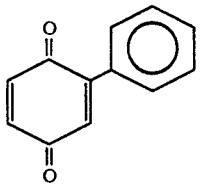
I-46
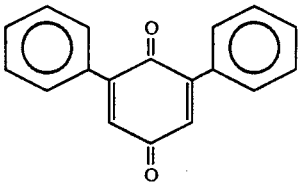
I-47
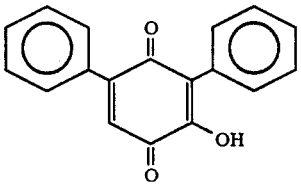
I-48
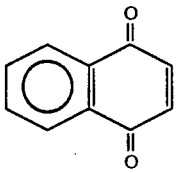

-continued

I-49

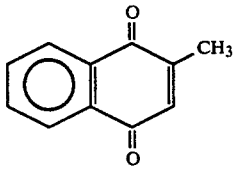

I-50

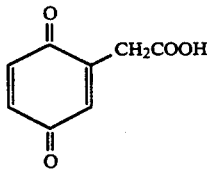

The image receiving element of the present invention comprises an image receiving layer comprising silver precipitation nuclei applied to a support, such as baryta paper, cellulose triacetate or a polyester compound, as described in U.S. Pat. No. 4,945,026. The image receiving element can be prepared by coating a support (which may be undercoated if necessary) with a coating solution of an appropriate cellulose ester such as cellulose diacetate in which silver precipitation nuclei are dispersed. The resulting cellulose ester layer is subjected to alkaline hydrolysis to convert at least a part thereof in the direction of the depth of the cellulose ester layer to cellulose.

In a particularly useful example, the layer containing silver precipitation nuclei and/or the lower cellulose ester layer thereunder which is not hydrolyzed (i.e., an unsaponificated layer or a timing layer), for example, an unhydrolyzed part of the cellulose ester layer containing cellulose diacetate, further contains one or more mercapto compounds suitable for improving the color tone or the stability of silver transfer images or other photographic properties. The mercapto compound is utilized by diffusing it from a position at which it is first placed during imbibition. Image receiving elements may be used as described in U.S. Pat. No. 3,711,283.

Preferred examples of the mercapto compounds include compounds described in JP-A-49-120634 (corresponding to U.S. Pat. No. 3,963,495) (the term "JP-A" as used herein means an "unexamined published Japanese patent application"), JP-B-56-44418 corresponding to U.S. Pat. Nos. 3,607,269 and 3,711,283) (the term "JP-B" as used herein means an "examined Japanese patent publication"), British Patent 1,276,961, JP-B-56-21140, JP-A-59-231537 (corresponding to U.S. Pat. No. 4,520,096) and JP-A-60-122939 (corresponding to U.S. Pat. No. 4,569,899).

Specific examples of the silver precipitation nuclei include heavy metals such as iron, lead, zinc, nickel, cadmium, tin, chromium, copper and cobalt, and noble metals such as gold, silver, platinum and palladium. Other useful silver precipitation nuclei include sulfides and selenides of heavy metals and noble metals, particularly sulfides and selenides of mercury, copper, aluminum, zinc, cadmium, cobalt, nickel, silver, lead, antimony, bismuth, cerium, magnesium, gold, platinum and palladium. In particular, gold, platinum, palladium and sulfides thereof are preferred among others.

It is preferred that an acidic polymer layer for neutralization (alkali neutralization layer) is provided between the unsaponificated layer (timing layer) and the support.

For example, polymer acids described in U.S. Pat. No. 3,594,164 can be employed in the alkali neutralization layer used in the present invention. Preferred examples of the polymer acids include maleic anhydride copolymers (for example, styrene-maleic anhydride copolymers, methyl vinyl ether-maleic anhydride copolymers and ethylene-maleic anhydride copolymers), and (meth)-acrylic copolymers (for example, acrylic acid-alkyl acrylate copolymers, acrylic acid-alkyl methacrylate copolymers, methacrylic acid-alkyl acrylate copolymers and methacrylic acid-alkyl methacrylate copolymers).

In addition, polymers containing sulfonic acid such as the acetalized product of polyethylenesulfonic acid or benzaldehydesulfonic acid and polyvinyl alcohol are useful.

Further, the neutralization layer may contain a mercapto compound used in the timing layer.

For the purpose of improving the film physical properties, these polymer acids may be used in combination with hydrolyzable alkali impermeable polymers (the above-described cellulose esters are particularly preferred) or alkali permeable polymers.

It is further preferred that the image receiving element has an image stabilizing layer for improving the image preservation property. Stabilizing agents used for this purpose, preferably include cationic polymer electrolytes. Particularly preferred examples of the cationic polymer electrolytes include aqueous latex dispersions described in JP-A-59-166940, U.S. Pat. No. 3,958,995, JP-A-55-142339, JP-A-54-126027, JP-A-54-155835 and JP-A-53-30328, polyvinyl pyridinium salts described in U.S. Pat. Nos. 2,548,564, 3,148,061 and 3,756,814, water soluble quaternary ammonium salt polymers described in U.S. Pat. No. 3,709,690 and water insoluble quaternary ammonium salt polymers described in U.S. Pat. No. 3,898,088.

A cellulose acetate is preferably used as a binder for the image stabilizing layer, and particularly cellulose diacetate having an acetylation degree of 40 to 49% is preferred. This image stabilizing layer is preferably provided between the neutralization layer and the timing layer described above.

For the purposes of preventing the timing rate from being prolonged by a change of the cellulose ester in storing for a long period of time and reducing the timing rate, the timing layer may contain an acid polymer (for example, a methyl vinyl ether-maleic anhydride copolymer or a copolymer of methyl vinyl ether and a half ester of maleic anhydride. The timing layer functions as a layer for delaying the decrease of pH in the image receiving layer. The timing rate means a rate of delaying the decrease of pH in the image receiving layer.

In order to prevent light from entering the inside of the element from a cross-sectional direction (light piping), the timing layer or the neutralization layer may contain a white pigment (for example, titanium dioxide, silicon dioxide, kaolin, zinc dioxide or barium sulfate).

Further, an intermediate layer is sometimes formed between the image receiving layer and the timing layer. Preferred examples of compounds which can be used in the intermediate layer include hydrophilic polymers such as gum arabic, polyvinyl alcohol and polyacrylamide.

Furthermore, it is preferred that the surface of the image receiving layer is provided with a separating layer to prevent a processing solution from adhering to the surface of the image receiving layer upon separation after development of the processing solution. Preferred compounds used in such a separating layer include compounds described in U.S. Pat. Nos. 3,772,024 and 3,820,999 and British Patent 1,360,653, in addition to gum arabic, hydroxyethyl cellulose, carboxymethyl cellulose, polyvinyl alcohol, polyacrylamide and sodium alginate.

Shading is required immediately after developing of a processing composition between the imagewise exposed light-sensitive layer and the image receiving layer until completion of a development reaction. When the shading does not function, the imagewise exposure cannot be put into practice. Preferred shading methods include the method of allowing a shading agent (for example, carbon black or an organic black pigment) to be contained in paper of the support, and the method of applying the above-described shading agent to the back surface of the support and further coating a white pigment (for example, titanium dioxide, silicon dioxide, kaolin, zinc dioxide or barium sulfate) thereon for whitening.

A moisture absorbing agent such as glycerine or a film quality improving agent such as a polyethyl acrylate latex may be added to the support to improve the curl or the brittleness.

It is further preferred that a protective layer is formed on the uppermost layer of the image receiving element. A matting agent can be added to the protective layer to give an improved adhesive property and writing property.

Gelatin, cellulose esters and polyvinyl alcohol can be used as binders for the above-described shading layer and protective layer.

In the present invention, a light-sensitive element is preferably used comprising a light-sensitive silver halide emulsion layer formed on one surface of a support, a polyethylene terephthalate film containing titanium dioxide or carbon black and having undercoat layers on both surfaces thereof, a protective layer is provided thereon, a carbon black layer is formed on the other surface of the support, and a protective layer is provided thereon.

In addition to the above-described layer constitution, a light-sensitive element is preferably used in which a titanium dioxide layer is formed on one surface of a support, a polyethylene terephthalate film containing titanium dioxide or carbon black and having undercoat layers on both surfaces thereof, a light-sensitive silver halide emulsion layer is formed thereon, a protective layer is provided thereon, a carbon black layer for improving color tone is formed on the other surface, and a protective layer is provided thereon. In place of the above-described carbon black or in addition thereto, a color dye can be used. When the polyethylene terephthalate film contains carbon black and/or the color dye, it is unnecessary to form the carbon black layer and/or a color dye layer on the other surface. The above-described titanium dioxide may be substituted by another white pigment.

In addition to the above-described polyester compound, paper laminated with polyethylene, baryta paper and cellulose triacetate are used as the support.

The above-described light-sensitive silver halide emulsion layer, protective layer and carbon black layer usually contain a hydrophilic binder such as gelatin.

The silver halide emulsion used in the present invention contains at least 0.5 mol % of silver iodide, wherein "at least 0.5 mol % of silver iodide" means that the amount of silver iodide contained in all silver halides is 0.5 mol % or more. The silver halide emulsion may therefore contain pure silver chloride, silver chlorobromide, pure silver bromide or pure silver iodide grains. It is however preferred that silver iodobromide or silver chloroiodobromide grains account for at least 90% of all silver halides, and it is more preferred that the silver halide grains consist of the silver iodobromide or silver chloroiodobromide grains alone.

The amount of silver iodide contained in silver iodobromide or silver chloroiodobromide grains is preferably 0.5 to 8 mol %, and more preferably 1 to 5 mol %. In order to reduce the image forming time, the amount of silver iodide is preferably 3 mol % or less.

The mean grain size (represented by the diameters of circles equivalent to the projected areas of grains) is not particularly restricted. Preferably, the mean grain size is 4 μm or less, more preferably 3 μm or less, and most preferably 0.2 to 2 μm. The grain size distribution may be either narrow or wide.

The silver halide grains contained in the silver halide emulsion may have a regular system crystal form such as cubic or octahedral, an irregular crystal form such as spherical or tabular (plate), or a composite form of these crystal forms.

The silver halide grains may be formed of different phases in the interior and the surface, or may be formed of a uniform phase. Further, a latent image may be mainly formed on the surface of the grains or in the interior of the grains. Furthermore, a latent image may not be localized to either of them. In particular, grains having a latent image formed mainly on the surface are more preferred.

The thickness of the silver halide emulsion layer is 0.5 to 8.0 μm, and particularly 0.6 to 6.0 μm. The amount of silver halide grains applied is 0.1 to 3 $g/m^2$ and preferably 0.2 to 1.5 $g/m^2$ as the amount of silver.

Various compounds can be added to the light-sensitive silver halide emulsion layers to prevent fogging during manufacturing stages, storage or photographic processing of the light-sensitive materials or to stabilize photographic properties thereof. These compounds include well-known antifogging agents and stabilizers.

Preferred examples of the antifogging agents and stabilizers include azoles (such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles and benzotriazoles), mercaptopyrimidines, mercaptotriazines, thioketo compounds, azaindenes (such as triazaindenes, tetraazaindenes and pentaazaindenes), benzenesulfonic acid compounds, benzensulfinic acid compounds, benzenesulfonic acid amides and α-lipoic acid. Typical examples thereof include 1-phenyl-2-mercaptotetraazole, 4-hydroxy-6-methyl-1,3,3a,7-tetraazaindene, 2-mercaptobenzothiazole and 5-carboxybutyl-1,2-dithiolane.

More detailed examples thereof and methods for using them are described, for example, in U.S. Pat. No. 3,982,947 and JP-B-52-28660.

Further, color sensitizers may be added to the silver halide emulsion layer used in the present invention. Preferred examples of the sensitizing dyes used include cyanine dyes, merocyanine dyes, complex cyanine dyes, complex merocyanine dyes, holopolar cyanine dyes, hemicyanine dyes, styryl dyes and hemioxanol dyes. Particularly useful dyes include cyanine dyes, merocyanine dyes and complex merocyanine dyes. Furthermore, a plurality of sensitizing dyes can be used in combination as described in JP-A-59-114533 and JP-A-61-163334.

Inorganic or organic hardening agents may be added to the light-sensitive element used in the present invention. Examples of such hardening agents include chromium salts (such as chrome alum and chromium acetate), aldehydes (such as formaldehyde, glyoxal and glutaraldehyde), N-methylol compounds (such as dimethylolurea and methylol dimethylhydantoin), dioxane derivatives (such as 2,3-dihydroxyoxane), active vinyl compounds (such as 1,3,5-triacryloyl-hexahydro-s-triazine) and mucohalogen acids (such as mucochloric acid and mucophenoxychloric acid). These hardening agents may be used alone or in combination.

Coating aids can be used in the silver halide emulsion layers and other hydrophilic colloidal layers of the light-sensitive elements used in the present invention. Examples of the coating aids include compounds described in the "Coating Aids" article of *Research Disclosure,* Vol. 176, No. 17643, page 26 (December, 1978) and JP-A-61-20035.

The silver halide emulsion layers and other hydrophilic colloidal layers of the light-sensitive element of the present invention may contain various compounds for the purposes of increasing sensitivity, enhancing contrast or accelerating development. Examples of such compounds include polyalkylene oxides; ether, ester and amine derivatives of polyalkylene oxides; thioether compounds; thiomorpholine compounds; quaternary ammonium compounds; urethane derivatives; urea derivatives; imidazole derivatives and 3-pyrazolidone derivatives. Compounds described in U.S. Pat. Nos. 2,400,532, 2,423,549, 2,716,062, 3,617,280, 3,772,021 and 3,808,003 can be used.

The silver halide emulsion layers and other hydrophilic colloidal layers of the light-sensitive element used in the present invention may contain dispersions of water-insoluble or slightly soluble synthetic polymers to give dimension stability. For example, alkyl (meth)-acrylates, alkoxyalkyl (meth)acrylates, glycidyl (meth)-acrylamides, vinyl esters (such as vinyl acetate), acrylonitrile, olefins and styrene can be used alone or in combination. These compounds may further contain acrylic acid, methacrylic acid, $\alpha,\beta$-unsaturated dicarboxylic acids, hydroxyalkyl (meth)acrylates and styrenesulfonic acid as monomer components.

Protective layers may be formed on the silver halide emulsion layers of the light-sensitive element of the present invention. The protective layers are formed of hydrophilic polymers such as gelatin, which may contain matting agents or lubricants such as polymethyl methacrylate latices and silica as described in JP-A-61-47946 and JP-A-61-75338.

The silver halide emulsion layers and other hydrophilic colloidal layers of the light-sensitive element of the present invention may contain dyes or ultraviolet light absorbers for the purpose of filtering or irradiation prevention.

In addition, the light-sensitive element of the present invention may contain antistatic agents, plasticizers and air antifogging agents.

Various processing compositions are used in the present invention (and may be referred to as processing elements). The processing compositions preferably contain developing agents, silver halide solvents and alkali agents. The developing agents and/or the silver halide solvents can also be added to the light-sensitive element and/or the image receiving element, depending their purpose.

The developing agents used in the present invention are benzene derivatives in which at least two hydroxyl and/or amino groups are substituted at the para- or ortho-positions of the benzene nucleus (for example, hydroquinone, amidol, metol, glycine, p-aminophenol and pyrogallol) and hydroxylamine derivatives (particularly, primary aliphatic N-substituted, secondary aliphatic N-subtitiuted, aromatic N-substituted or $\beta$-hydroxylamines). These hydroxylamine derivatives are soluble in aqueous alkali solutions. Examples thereof include hydroxylamine, N-methylhydroxylamine, N-ethylhydroxylamine, compounds described in U.S. Pat. No. 2,857,276 and N-alkoxyalkyl-substituted hydroxylamines described in U.S. Pat. Nos. 3,293,034, and 3,362,961.

Hydroxylamine derivatives having tetrahydrofurfuryl groups described in JP-A-49-88521 are also used.

Furthermore, aminoreductones described in West German Patent Application (OLS) Nos. 2,009,054, 2,009,055 and 2,009,078, and heterocyclic aminoreductones described in U.S. Pat. No. 4,128,425 are also used.

Moreover, tetraalkylreductic acids described in U.S. Pat. No. 3,615,440 can also be used.

Of these, it is particularly preferred to use hydroxylamine compounds represented by the formula (II):

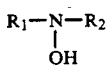

$$R_1-\underset{\underset{OH}{|}}{N}-R_2 \qquad \text{(II)}$$

wherein $R_1$ represents an alkyl group, an alkoxyalkyl group or an alkoxyalkoxyalkyl group, and $R_2$ represents a hydrogen atom, an alkyl group, an alkoxyalkyl group, an alkoxyalkoxyalkyl group or an alkenyl group. The total number of carbon atoms of $R_1$ and $R_2$ is preferably 2 to 10.

In particular, N,N-diethylhydroxylamine and N,N-dimethoxyethylhydroxylamine are preferably used.

The developing agents are used preferably in an amount of 0.1 to 40 g per 100 g of processing composition, and more preferably in an amount of 1 to 20 g per 100 g.

Auxiliary developing agents such as phenidone derivatives, p-aminophenol derivatives and ascorbic acid can be used in combination with the above-described developing agents. Of these, the phenidone derivatives are preferably used.

The silver halide solvents used in the present invention include ordinary fixing agents (such as sodium thiosulfate, sodium thiocyanate, ammonium thiosulfate and compounds described in U.S. Pat. No. 2,543,181), combinations of cyclic imides and nitrogen bases (for example, combinations of barbiturates or uracil and ammonia or amines), and combinations described in U.S. Pat. No. 2,857,274. Further, 1,1-bissulfonylalkanes and derivatives thereof can be used as the silver halide solvents in the present invention.

The processing compositions contain alkalis, preferably hydroxides of alkali metals such as sodium hydroxide and potassium hydroxide.

When the processing composition is developed as a thin layer between the light-sensitive element and the image receiving element superimposed on each other, it is preferred that the processing composition contains a polymer film forming agent, a thickening agent or a viscosity improver, as described in U.S. Pat. Nos.

2,616,804 and 2,647,056. Hydroxyethyl cellulose and sodium carboxymethyl cellulose are particularly preferred for this purpose, and added to the processing compositions at a concentration effective to give an appropriate viscosity by known techniques of the diffusion transfer photographic processes.

The processing compositions may further contain other aids known in the silver salt diffusion transfer processes, such as antifogging agents, toning agents and stabilizers.

The present invention will be illustrated in greater detail with reference to the following examples, which are however not to be construed as limiting the invention.

COMPARATIVE EXAMPLE 1

1. Preparation of Image Receiving Element

The following layers were in turn formed on a support, paper laminated with polyethylene, to prepare an image receiving element. The numerical values shown in brackets indicate the amount applied in g/m$^2$.

(1) Neutralization Layer
cellulose acetate (acetylation degree: 55%) [6.0]
methyl vinyl ether-maleic anhydride copolymer [4.0]
Uvitex OB (trade name, Ciba-Geigy) [0.04]
1-(4-hexylcarbamoylphenyl)-2,3-dihydroxyimidazole-2-thione [0.25]

(2) Image Stabilizing Layer
cellulose acetate (acetylation degree: 46%) [4.0]
the following polymer [2.0]

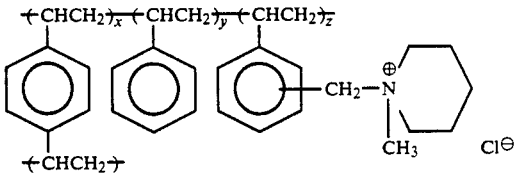

x:y:z = 5:47.5:47.5

(3) Timing Layer
cellulose acetate (acetylation degree: 55%) [8.0]

(4) Image Receiving Layer
cellulose acetate (acetylation degree: 55%) [2.0]
palladium sulfide [$7.5\times10^{-4}$]
1-(4-hexylcarbamoylphenyl)-2,3-dihydroxyimidazole-2-thione [$1.0\times10^{-2}$]

(5) Saponification
Saponification was conducted from the surface using a mixture of 12 g of sodium hydroxide, 24 g of glycerin and 280 ml of methanol, followed by washing.

(6) Separating Layer
butyl methacrylate-acrylic acid copolymer (molar ratio: 15:85) [0.1]

(7) Back Layer
The back surface of the above-described support was coated with a shading layer, a white layer and a protective layer.

(7-1) Shading Layer
carbon black [4.0]
gelatin [8.0]

(7-2) White Layer
titanium dioxide [6.0]
gelatin [0.7]

(7-3) Protective Layer
polymethyl methacrylate grains (mean size: 0.05 μm) [0.2]
gelatin [1.6]

2. Preparation of Light-Sensitive Element

The following layers were applied to the support (polyethylene terephthalate) to prepare a light-sensitive element. The numerical values shown in brackets indicate the amount applied in g/m$^2$.

(1) Colloidal Layer
colloidal silver (mean size: 0.01 μm) [0.002]
gelatin [0.9]

(2) Light-Sensitive Layer
Emulsion of silver iodobromide (having a mean size of 1.1 μm) (AgI content: 2.5 mol %, core-shell type structure) [0.55, converted to silver]
4-hydroxy-6-methyl-1,3,3a,7-tetrazaindene [0.01]
The following sensitizing dyes (A), (B) and (C) [$3.2\times10^{-4}$], [$3.2\times10^{-4}$] and [$1.2\times10^{-4}$], respectively

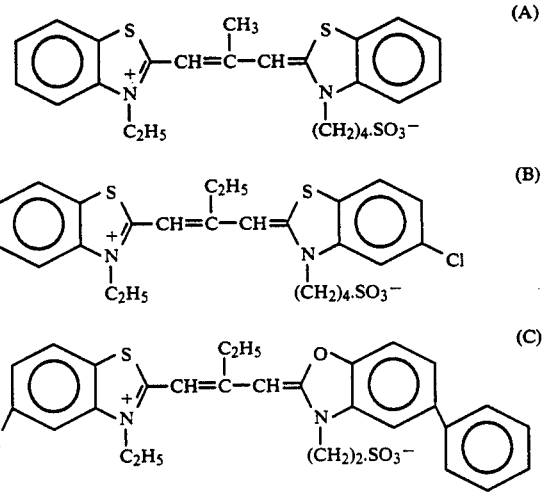

gelatin [3.9]

(3) Protective Layer
gelatin [0.7]
polymethyl methacrylate grains (mean size: 4.7 μm) [0.1]

(4) Back Layer (4-1) Shading Layer
carbon black [4.0]
gelatin [2.0]

(4-2) Protective Layer
gelatin [0.7]
polymethyl methacrylate grains (mean size: 0.05 μm) [0.1]

3. Preparation of Processing Solution and Production of Pods

A processing solution was prepared in a stream of nitrogen to prevent the solution from being oxidized by air. After preparation of the solution according to the following formulation, a plurality of cleavable containers (pods) were charged with 0.7 g/pod of the solution to produce a processing composition.

| | |
|---|---|
| titanium dioxide | 5 g |
| potassium hydroxide | 280 g |
| uracil | 90 g |
| tetrahydropyrimidinethione | 0.2 g |
| 2,4-dimercaptopyrimidine | 0.2 g |
| sodium 3-(5-mercaptotetrazolyl)benzenesulfonate | 0.2 g |
| potassium iodide | 0.8 g |
| zinc nitrate.$9H_2O$ | 40 g |
| triethanolamine | 6 g |

-continued

| | |
|---|---|
| hydroxyethyl cellulose | 45 g |
| N,N-bis(methoxyethyl)hydroxylamine (17% aqueous solution) | 220 g |
| 4-methyl-4-hydroxymethyl-1-phenyl-3-pyrazolidinone | 0.2 g |
| $H_2O$ | 1300 ml |

4. Development Processing

The sample in which above-described image receiving element, light-sensitive element and processing composition are combined, was subjected to exposure of continuous gradation for 1/10 second, and development processing was conducted so as to give a liquid thickness of 35 μm at 25° C. Then, 15 seconds after initiation of the development processing, the image receiving element which was separated from the light-sensitive element was subjected to the measurement of optical density to evaluate the minimum density (Dmin), the maximum density (Dmax) and the sensitivity (S0.6). The sensitivity (S0.6) was expressed in the relative value of the logarithm of the reciprocal of an exposure amount at the point of Dmin+0.6.

EXAMPLE 1

Sample was prepared in accordance with Comparative Example 1 except that compounds listed in Table 1, according to the present invention were added to the processing composition described in Comparative Example 1. The amount of the compounds added is expressed in a molar ratio based on the amount of silver applied, and indicates the optimum values for each of the compounds added. For some compounds, the dependence on the amount added is indicated. Results thereof are shown in Table 1.

TABLE 1

| Compound Added | Amount Added | Maximum Density | Sensitivity | Minimum Density |
|---|---|---|---|---|
| I-1 | $3.5 \times 10^{-4}$ | 1.61 | 100 | 0.11 |
| I-2 | $3.5 \times 10^{-4}$ | 1.61 | 99 | 0.11 |
| I-4 | $5.5 \times 10^{-4}$ | 1.68 | 93 | 0.11 |
| I-6 | $1.0 \times 10^{-3}$ | 1.70 | 88 | 0.11 |
| I-9 | $8.0 \times 10^{-5}$ | 1.72 | 93 | 0.11 |
| I-10 | $6.0 \times 10^{-5}$ | 1.69 | 90 | 0.11 |
| I-10 | $1.0 \times 10^{-4}$ | 1.78 | 85 | 0.12 |
| I-14 | $1.0 \times 10^{-4}$ | 1.75 | 98 | 0.11 |
| I-15 | $4.0 \times 10^{-6}$ | 1.60 | 99 | 0.11 |
| I-15 | $3.5 \times 10^{-5}$ | 1.92 | 95 | 0.11 |
| I-15 | $7.0 \times 10^{-5}$ | 2.01 | 91 | 0.11 |
| I-19 | $5.0 \times 10^{-5}$ | 1.75 | 96 | 0.11 |
| I-34 | $5.0 \times 10^{-4}$ | 1.61 | 100 | 0.11 |
| I-43 | $3.5 \times 10^{-4}$ | 1.61 | 99 | 0.11 |
| Not added* | | 1.55 | 100 | 0.11 |
| I-10 | $1.0 \times 10^{-2}$ | 1.46 | 71 | 0.31 |
| I-15 | $1.0 \times 10^{-2}$ | 1.41 | 66 | 0.45 |

Note:
*: Comparative Example 1

In all samples of this example, metallic luster was not developed, and changes in color tone were very slight.

EXAMPLE 2

Sample was prepared in accordance with Comparative Example 1 except that compounds listed in Table 2, according to the present invention were added to the light-sensitive element described in Comparative Example 1. The amount of the compounds added is expressed in a molar ratio to the amount of silver applied, and indicates the optimum values for each of the compounds added. For some compounds, the dependence on the amount added is indicated. Results thereof are shown in Table 2.

TABLE 2

| Compound Added | Amount Added | Maximum Density | Sensitivity | Minimum Density |
|---|---|---|---|---|
| I-1 | $2.0 \times 10^{-4}$ | 1.60 | 100 | 0.11 |
| I-2 | $2.0 \times 10^{-4}$ | 1.59 | 100 | 0.11 |
| I-4 | $3.0 \times 10^{-4}$ | 1.65 | 95 | 0.11 |
| I-6 | $5.0 \times 10^{-4}$ | 1.65 | 95 | 0.11 |
| I-9 | $4.0 \times 10^{-5}$ | 1.67 | 96 | 0.11 |
| I-10 | $3.5 \times 10^{-5}$ | 1.58 | 95 | 0.11 |
| I-10 | $5.0 \times 10^{-5}$ | 1.63 | 92 | 0.11 |
| I-14 | $7.0 \times 10^{-5}$ | 1.71 | 98 | 0.11 |
| I-15 | $3.5 \times 10^{-6}$ | 1.58 | 99 | 0.11 |
| I-15 | $1.8 \times 10^{-5}$ | 1.63 | 97 | 0.11 |
| I-15 | $5.3 \times 10^{-5}$ | 1.80 | 95 | 0.11 |
| I-19 | $3.5 \times 10^{-5}$ | 1.70 | 97 | 0.11 |
| I-34 | $3.5 \times 10^{-4}$ | 1.59 | 100 | 0.11 |
| I-43 | $2.5 \times 10^{-4}$ | 1.60 | 100 | 0.11 |
| Not added* | | 1.55 | 100 | 0.11 |
| I-10 | $1.0 \times 10^{-2}$ | 1.41 | 68 | 0.38 |
| I-15 | $1.0 \times 10^{-2}$ | 1.37 | — | 0.62 |

Note:
*: Comparative Example 1

In all samples of this example, metallic luster was not developed, and changes in color tone were very slight. One of the comparative examples was too high in the minimum density to determine the sensitivity, as with Example 3.

EXAMPLE 3

Sample was prepared in accordance with Comparative Example 1 except that the compound listed in Table 3, according to the present invention was added to the image receiving element described in Comparative Example 1. The amount of the compounds added is expressed in a molar ratio to the amount of silver applied, and indicates the optimum values for each of the compounds added. For some compounds, the dependence on the amount added is indicated. Results thereof are shown in Table 3.

TABLE 3

| Compound Added | Amount Added | Maximum Density | Sensitivity | Minimum Density |
|---|---|---|---|---|
| I-1 | $4.0 \times 10^{-4}$ | 1.65 | 99 | 0.11 |
| I-2 | $4.0 \times 10^{-4}$ | 1.65 | 97 | 0.11 |
| I-4 | $7.0 \times 10^{-4}$ | 1.71 | 90 | 0.11 |
| I-6 | $1.0 \times 10^{-3}$ | 1.70 | 85 | 0.12 |
| I-9 | $8.0 \times 10^{-5}$ | 1.81 | 91 | 0.11 |
| I-10 | $7.0 \times 10^{-5}$ | 1.64 | 92 | 0.11 |
| I-10 | $2.0 \times 10^{-4}$ | 1.70 | 82 | 0.11 |
| I-14 | $1.5 \times 10^{-4}$ | 1.78 | 98 | 0.11 |
| I-15 | $6.0 \times 10^{-6}$ | 1.65 | 97 | 0.11 |
| I-15 | $4.0 \times 10^{-5}$ | 1.91 | 92 | 0.11 |
| I-15 | $1.5 \times 10^{-4}$ | 1.98 | 85 | 0.15 |
| I-19 | $6.0 \times 10^{-5}$ | 1.73 | 95 | 0.11 |
| I-34 | $7.0 \times 10^{-4}$ | 1.63 | 100 | 0.11 |
| I-43 | $4.0 \times 10^{-4}$ | 1.65 | 100 | 0.11 |
| Not added* | | 1.55 | 100 | 0.11 |
| I-10 | $1.0 \times 10^{-2}$ | 1.42 | 66 | 0.40 |
| I-15 | $1.0 \times 10^{-2}$ | 1.37 | — | 0.62 |

Note:
*: Comparative Example 1

In all samples of this example, metallic luster was not developed, and changes in color tone were very slight.

EXAMPLE 4

Sample was prepared in accordance with Comparative Example 1 except that the compound according to the present invention was added to the processing composition and the light-sensitive element described in Comparative Example 1. The amount of the compound added is expressed in a molar ratio to the amount of silver applied. Results thereof are shown in Table 4.

TABLE 4

| Compound Added | Amount Added: Processing Solution | Amount Added: Light-Sensitive Element | Maximum Density | Sensitivity | Minimum Density |
|---|---|---|---|---|---|
| I-15 | $4.0 \times 10^{-6}$ | $3.5 \times 10^{-6}$ | 1.58 | 99 | 0.11 |
| | $4.0 \times 10^{-6}$ | $1.8 \times 10^{-5}$ | 1.63 | 97 | 0.11 |
| | $4.0 \times 10^{-6}$ | $5.3 \times 10^{-5}$ | 1.85 | 95 | 0.11 |
| | $4.0 \times 10^{-6}$ | $7.2 \times 10^{-5}$ | 1.91 | 92 | 0.12 |

In all samples of this example, metallic luster was not developed, and changes in color tone were very slight.

In the silver halide salt diffusion transfer processes, by addition of the compounds represented by formula (I) as the present invention, the maximum density can be increased for a short period of time without increasing the minimum density, without largely decreasing the sensitivity, without developing metallic luster, and with very slight changes in color tone.

While the invention has been described in detail and with reference to specific examples, it will be apparent to one skilled in the art that various changes and modifications can be made without departing from the spirit and scope thereof.

What is claimed is:

1. A method for forming images by silver salt diffusion transfer comprising imagewise exposing a light-sensitive element comprising a light-sensitive silver halide emulsion layer, developing the light-sensitive element in the presence of a silver halide solvent using an alkaline processing composition to turn at least a part of unexposed silver halide of the light-sensitive silver halide emulsion layer into a transfer silver halide complex salt, and transferring at least a part of the silver halide complex salt to an image receiving layer comprising a silver precipitating agent to form images on the image receiving layer, wherein at least one compound represented by formula (I) is added to at least one of the light-sensitive element, an image receiving element comprising the image receiving layer, and the processing composition in an amount of at least $3 \times 10^{-6}$ and less than $2 \times 10^{-3}$ mol based on one mol of silver applied per unit area ($m^2$):

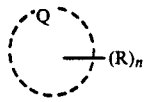

(I)

wherein Q represents benzoquinone; R represents an alkyl or alkoxy group of 1 to 6 carbon atoms; and n is an integer of 2 to 4.

2. The method of claim 1, wherein the compound is added to the processing composition.

3. The method of claim 1, wherein the image receiving element further comprises an alkali neutralization layer and a timing layer.

4. The method of claim 3, wherein the image receiving element comprises an intermediate layer between the image receiving layer and the timing layer.

5. The method of claim 1, wherein the surface of the image receiving layer is provided with a separating layer.

6. The method of claim 1, wherein the light-sensitive silver halide emulsion layer contains grains having at least 0.5 mol % of silver iodide.

7. The method of claim 1, wherein grains of the light-sensitive silver halide emulsion layer are at least 90% silver, iodobromide or silver chloroiodobromide grains.

8. The method of claim 1, wherein the silver halide emulsion layer has a thickness of 0.5 to 8 μm.

9. The method of claim 8, wherein the thickness is 0.6 to 6 μm.

10. The method of claim 1, wherein an amount of silver halide grains applied in the silver halide emulsion later is 0.1 to 3 $g/m^2$ based on the amount of silver.

11. The method of claim 10, wherein the amount of silver halide grains applied is 0.2 to 1.5 $g/m^2$.

12. The method of claim 1, wherein the processing composition contains a developing agent.

13. The method of claim 12, wherein the developing agent is represented by formula (II):

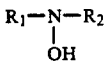

(II)

wherein $R_1$ represents, an alkyl group, an alkoxyalkyl group or an alkoxyalkoxyalkyl group; and $R_2$ represents a hydrogen atom, an alkyl group, an alkoxyalkyl group, an alkoxyalkoxyalkyl group or an alkenyl group.

14. The method of claim 13, wherein a total number of carbon atoms of $R_1$ and $R_2$ is 2 to 10.

15. The method of claim 12, wherein the developing agent is used in amount of 0.1 to 40 g per 100 g of the processing composition.

16. The method of claim 15, wherein the amount of developing agent used is 1 to 20 g per 100 g.

17. The method of claim 3, wherein at least one of the image receiving layer and the timing layer contain at least one mercapto compound.

* * * * *